US007442867B1

(12) United States Patent
Hunter

(10) Patent No.: US 7,442,867 B1
(45) Date of Patent: Oct. 28, 2008

(54) DRUM

(76) Inventor: James E. Hunter, P.O. Box 239, Waldo, FL (US) 32694

( * ) Notice: Subject to any disclaimer, the term of this patent is extended or adjusted under 35 U.S.C. 154(b) by 0 days.

(21) Appl. No.: 11/808,016

(22) Filed: Jun. 6, 2007

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | | |
|---|---|---|---|---|---|
| 614,694 | A | | 11/1898 | Boulanger | |
| 1,407,108 | A | | 2/1922 | Williams | |
| 2,331,096 | A | | 10/1943 | Strupe | |
| 3,482,479 | A | * | 12/1969 | Della-Porta | 84/411 R |
| 4,060,018 | A | | 11/1977 | Gilbrech | |
| 5,375,500 | A | | 12/1994 | Halpin | |
| 5,517,890 | A | | 5/1996 | Cooperman | |
| 5,936,175 | A | | 8/1999 | Simons | |
| 6,747,199 | B2 | * | 6/2004 | Shah | 84/411 R |

* cited by examiner

*Primary Examiner*—Kimberly R Lockett
(74) *Attorney, Agent, or Firm*—Stephen R. Greiner

(57) ABSTRACT

A drum having hidden, drum head tensioning features. The drum features a drum head assembly being positioned within a drum body. The drum head assembly includes a mounting frame having a mounting ring being loosely fitted within the drum body. A number of mounting brackets are affixed at spaced apart locations to the interior of the mounting ring. A number of first threaded fasteners are threadably engaged with the mounting ring and extend radially outward therefrom so as to selectively press against, and grip, the drum body. A number of second threaded fasteners extend upwardly from the mounting brackets. A drum head is positioned upon the mounting frame so as to cover the top of the mounting ring and to extend downwardly between the mounting ring and the drum body. A retaining band clamps the drum head against the mounting ring. The retaining band has an elongated strip extending snugly over the drum head and extending around the bottom of the mounting ring. The retaining band also has opposed ends that are turned inwardly so as to form a pair of spaced-apart fins that extend through the notch in the mounting frame. A third threaded fastener connects the fins for selectively drawing the fins toward one another and varying the tightness of the band around the mounting ring and drum head. A tensioning ring is slidably positioned within the top of the mounting ring and is positioned atop the second threaded fasteners whereby tightening the second threaded fasteners selectively raises the tensioning ring to tighten the drum head.

1 Claim, 3 Drawing Sheets

DRUM

FIELD OF THE INVENTION

The present invention relates generally to musical instruments and, more particularly, to drums having head tightening features.

BACKGROUND OF THE INVENTION

The head of a conventional drum is pulled over the open top of a cylindrical body. External hardware is provided about the periphery of the drum body for securing and tensioning the head. Unfortunately, this hardware is esthetically displeasing. Furthermore, it can impede the play of a drummer, particularly one using his hands, by presenting irregular surfaces that are likely to be inadvertently struck from time to time. Internal hardware for securing and tensioning drum heads has been proposed, but, heretofore, has not seen widespread acceptance by drummers since such has been costly and complicated in terms of construction and has been difficult to manipulate and adjust.

SUMMARY OF THE INVENTION

In light of the problems associated with the construction of conventional drums, it is a principal object of the invention to provide a new drum with hardware for securing and tensioning its drum head being located internally, within a drum body where such will not curb or hinder the ability of a drummer to play. Furthermore, my drum is aesthetically pleasing and has no irregular surface projections that are safety hazards.

It is another object of the invention to provide a drum of the type described that is easy to adjust and tune. My drum can be set up, adjusted, tuned, and taken down with minimal instruction and without resort to specialized tools. My drum is believed to be intuitive to use with the head securing and tensioning means always remaining accessible to a drummer.

Still another object of the invention is to provide a drum featuring a drum body whose external surfaces can be fully employed to carry artwork, logos, or other indicia.

It is an object of the invention to provide improved features and arrangements thereof in a drum for the purposes described that is lightweight in construction, inexpensive to manufacture, and fully dependable in use.

Briefly, the drum in accordance with this invention achieves the intended objects by featuring a mounting frame through which threaded fasteners project outwardly to grip a drum body. The mounting frame has a number of brackets affixed about its interior. Each of the brackets carries a threaded fastener that projects upwardly. A tensioning ring is slidably fitted within the mounting frame and is provided with a number of inwardly directed tabs that rest upon the upwardly projecting fasteners. A flexible drum head is pulled taught across the respective tops of the mounting frame and the tensioning ring. A retaining band extends snugly over the drum head and clamps the drum head against the exterior of the mounting frame. By tightening the outwardly projecting fasteners, the mounting frame is locked within the drum body. By tightening the upwardly projecting fasteners, the tensioning ring is selectively raised to tighten the drum head.

The foregoing and other objects, features, and advantages of my drum will become readily apparent upon further review of the following written description and accompanying drawings.

BRIEF DESCRIPTION OF THE DRAWINGS

My drum can be more readily described with reference to the accompanying drawings, in which.

Similar reference characters denote corresponding features consistently throughout the accompanying drawings.

DETAILED DESCRIPTION OF THE INVENTION

Figure 1:
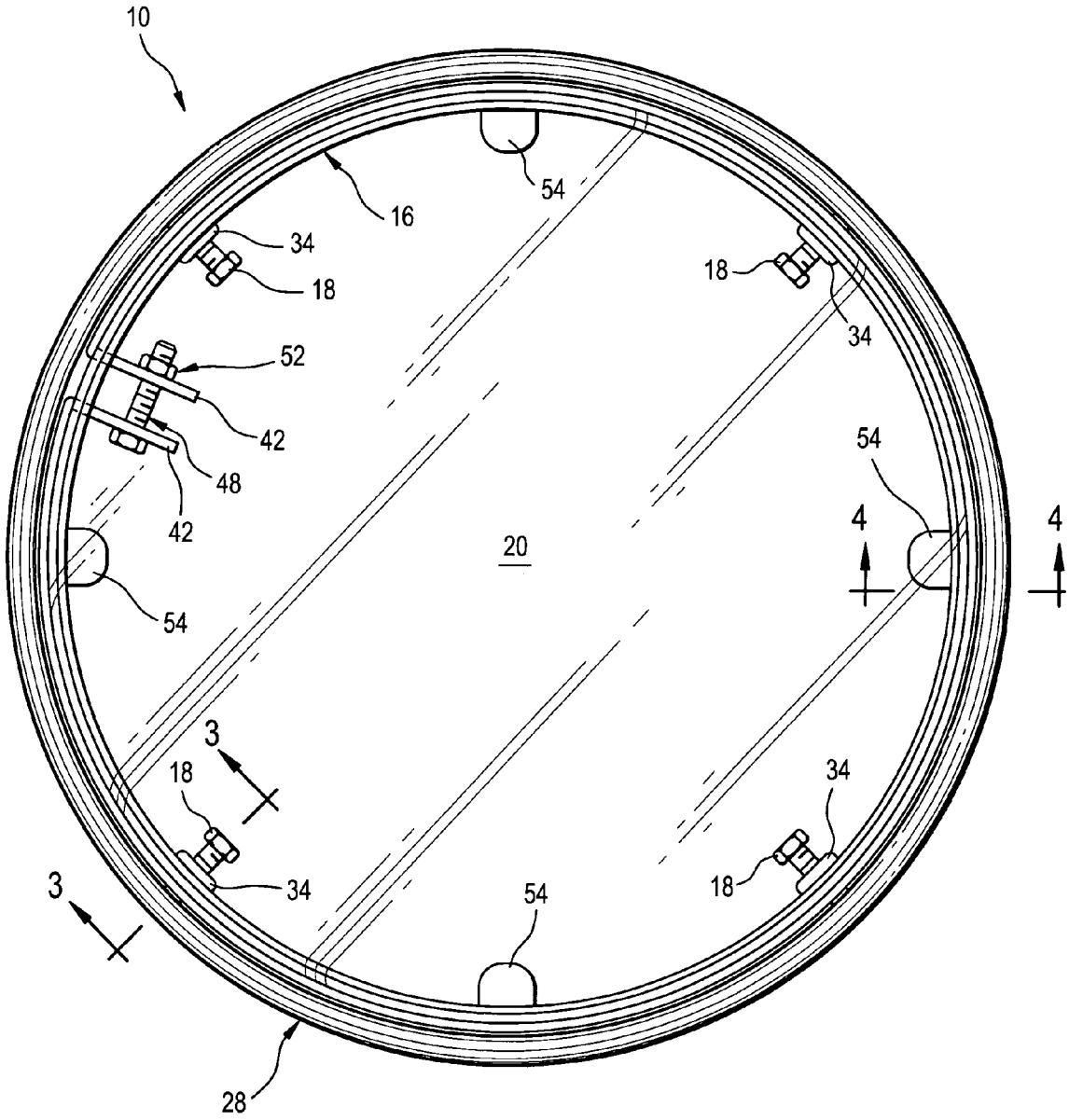
FIG. 1 is a top view of my drum.
Figure 2:
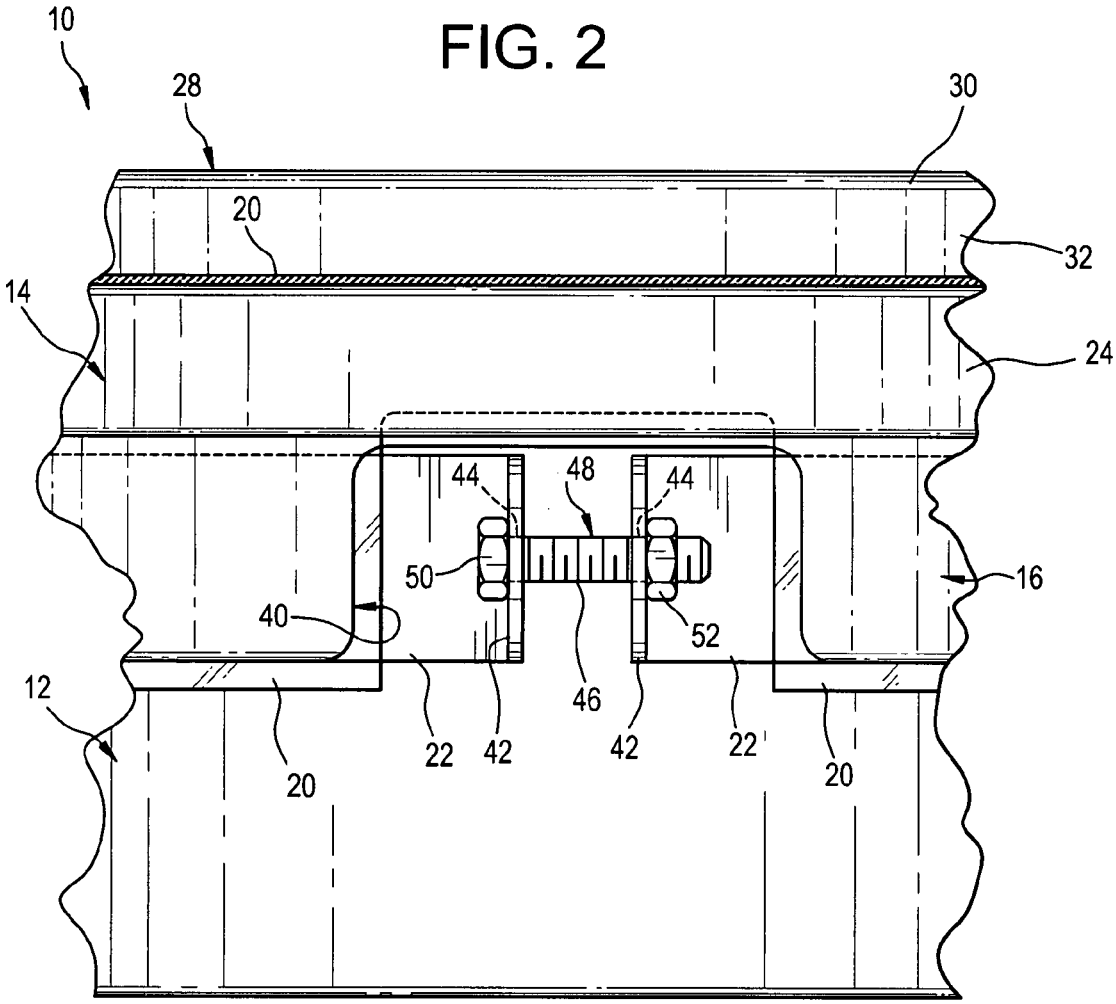
FIG. 2 is an interior elevation of the drum with portions broken away to show retaining ring details.
Figure 3:
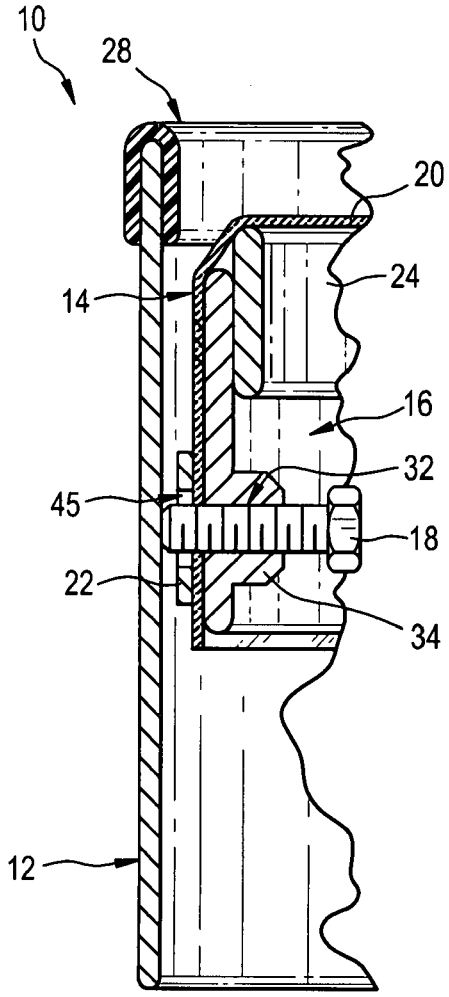
FIG. 3 is a cross-sectional view taken along line 3-3 of FIG. 1.
Figure 4:
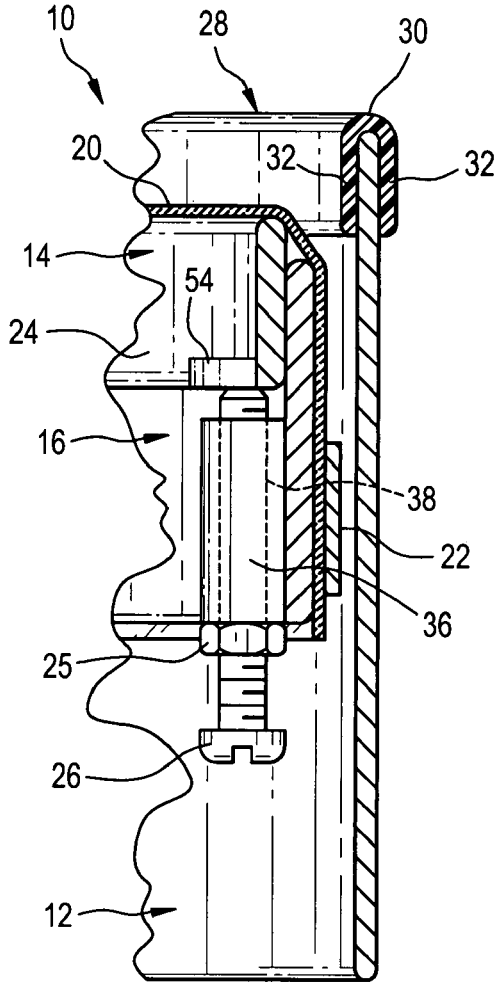
FIG. 4 is a cross-sectional view taken along line 4-4 of FIG. 1.

Referring now to the FIGS., a drum in accordance with the present invention is shown at 10. Drum 10 includes a drum body 12 within the open top of which is releasably secured a drum head assembly 14. Assembly 14 has a mounting frame 16 that is attached to drum body 12 by a number of threaded fasteners 18. A drum head 20 is stretched over frame 16 and is held in place by a retaining band 22 that extends around both drum head 20 and mounting frame 16. A tensioning ring 24 is snugly, yet slidably, fitted within mounting frame 16 and is driven upwardly against the bottom of drum head 20 by threaded fasteners 26 engaged with mounting frame 16.

Drum body 12 is a hollow cylinder formed of wood, plastic, metal, fiberglass, graphite composite or any other suitable material. The dimensions of the material(s) employed to construct drum body 12 are largely a matter design choice. Thicker and heavier materials tend to provide a more significant bass response whereas materials with opposite characteristics tend to provide a more significant treble response and are somewhat easier to transport. Nevertheless, a durable drum body 12 with a well balanced tone is formed from a steel sheet having a thickness of about 0.125 inches (0.32 cm) and a height of about 4 inches (10.2 cm) rolled and welded into a cylinder having a diameter of 14 inches (35.6 cm).

The top of drum body 12 is covered with a resilient guard 28 upon which drum sticks can be struck without harm thereto. Guard 28 is provided with a cross section resembling an inverted "U" and has a crosspiece 30 from the opposite ends of which a pair of legs 32 extend downwardly. Guard 28 is formed from a PVC polymer, having a color that complements that of drum body 12. If desired, the grip of guard 28 upon the top of drum body 12 can be enhanced by the addition of an internal, metallic clip (not shown) that extends the length guard 28 and through crosspiece 20 and legs 32. Edge trim materials produced by Trim-Lok, Inc., of Buena Park, Calif., for example, are suitable for use as guard 28.

Mounting frame 16 is a stiff, metallic ring fitted within the top of drum body 12. As shown, frame 16 has a height that is about one-half that of body 12 and external dimensions that are somewhat smaller than the internal dimensions of drum body 12 so that the height of frame 16, and hence that of drum head 20, relative to the top of drum body 12 can be set as a drummer may desire. A number of internally threaded openings 32 are provided about the periphery of mounting frame 16 for the threaded engagement of threaded fasteners 18. Fasteners 18 extend radially outward through openings 32 so as to press against, and grip, the interior of drum body 12 at spaced apart locations.

Mounting frame 16 is reinforced by the provision of bosses 34 that surround each of threaded openings 32 and extend openings 32 inwardly toward the center of drum 10. Bosses 34 can be applied to frame 16 by casting or forming frame 16 so that they are an integral part thereof from the time of manufacture onward. On the other hand, bosses 34 can be made separately and affixed later to mounting frame 16 as by welding or other suitable method. Preferably, bosses 34 project from the interior of frame 16 so as to not interfere with the placement of drum head 20 and retaining band 22.

Between bosses 34, a number of brackets 36 are affixed to the interior of mounting frame 16. Like bosses 34, brackets 36 can be cast or made so as to be an integral part of frame 16 from the time of manufacture or can be affixed thereto by welding or otherwise. Each of brackets 36 is provided with an internally threaded bore 38 for the threaded engagement of threaded fasteners 26. Fasteners 26 extend upwardly through bores 38 so as to press against tensioning ring 24 as will be described below. Lock nuts 25 are threaded onto the bottoms of fasteners 26 to prevent fasteners 26 from loosening from brackets 36 during vigorous play of drum 10.

A notch 40 is provided in the bottom of mounting frame 16 remote from bosses 34 and brackets 36 for access to retaining band 22. Notch 40 has a height that is about one-half the height of mounting frame 16. The width of notch 40 is about two times that of the height of notch 40.

Drum head 20 is formed from a thin sheet of plastic, animal hide, or other suitable material. Drum head 20 is cut in the shape of a circle with a diameter sufficient to cover the top and exterior surface of mounting frame 16 when pulled downwardly. For the passage of threaded fasteners 18 to drum body 12 and for access to retaining band 22 through notch 40, portions of drum head 20 are cut away at the time of its installation within drum 10. Since the cutaway portions are remote from the striking surface of drum head 20, i.e., the surface bounded by tensioning ring 24, they do not measurably affect the quality of the sounds emitted by drum 10.

Retaining band 22 extends snugly over drum head 20 and clamps drum head 20 against the exterior of mounting frame 16. Band 22 is a flexible, metallic strip with a length that is slightly greater than the circumference of mounting frame 16 and a height that is slightly less than that of notch 40. Band 22 is provided with apertures 45 at spaced intervals for the passage of threaded fasteners 18 to drum body 12. The opposed ends of band 22 are turned inwardly so as to form a pair of fins 42 that extend inwardly through notch 40 toward the center of drum 10. Each of fins 42 is provided with a hole 44 for the passage of the threaded shaft 46 of a bolt 48. During use, the head 50 of bolt 48 is positioned against one of fins 42 and a nut 52, tightly threaded onto shaft 46, engages the other one of fins 42 to lock band 22 and drum head 20 upon mounting frame 16.

To fit within mounting frame 16, tensioning ring 24 is provided with a diameter that is slightly less than that of mounting frame 16 and a height that is about one-half that of mounting frame 16. Prior to screwing fasteners 26 through bores 38, ring 24 will rest upon brackets 36 positioned around mounting frame 16. To ensure a firm contact between fasteners 26 and ring 24, ring 24 is provided with a number of inwardly directed tabs 54 that are positioned around ring 24 so as to align with upwardly projecting fasteners 26. Each of tabs 54 can be cast or otherwise formed so as to be an integral part of ring 24 or can be subsequently affixed thereto by welding or other suitable method. By tightening the upwardly projecting fasteners 26 against tabs 54, ring 24 is selectively raised to tighten drum head 20.

While the invention has been described with a high degree of particularity, it will, be appreciated by those skilled in the art that modifications can be made to it. For example, drum body 12 and the closely fitting parts of drum head assembly 14 need not be made with a circular outline or in the size described. In fact, the construction of drum 10 offers drum manufacturers an opportunity to produce drums having unusual, closed, geometric shapes like stars and moons. Furthermore, the number and location of threaded fasteners 18 and 26 used, respectively, to fasten mounting frame 16 to body 12 and to elevate tensioning ring 24 can be varied as desired. Therefore, it is to be understood that the present invention is not limited solely to drum 10 described above, but encompasses any and all drums within the scope of the following claims.

I claim:

1. A drum, comprising:

a drum body;

a drum head assembly being positioned within said drum body, said drum head assembly including:

a mounting frame including:

a mounting ring being loosely fitted within said drum body, said mounting ring having a notch in the bottom thereof; and, a plurality of mounting brackets being affixed at spaced apart locations to the interior of said mounting ring;

a plurality of first threaded fasteners, each of which being threadably engaged with said mounting ring and extending radially outward therefrom so as to selectively press against, and grip, said drum body;

a plurality of second threaded fasteners, each of which being threadably engaged with a respective one of said mounting brackets so as to extend upwardly therefrom;

a drum head being positioned upon said mounting frame so as to cover the top of said mounting ring and to extend downwardly between said mounting ring and said drum body;

a retaining band for clamping said drum head against said mounting ring; said retaining band including:

an elongated strip extending snugly over said drum head and extending around the bottom of said mounting ring, said retaining band having opposed ends turned inwardly so as to form a pair of spaced-apart fins that extend through said notch in said mounting frame; and, a third threaded fastener connecting said fins for selectively drawing said fins toward one another and varying the tightness of said band around said mounting ring and drum head; and, a tensioning ring being slidably positioned within the top of said mounting ring and being positioned atop said second threaded fasteners whereby tightening said second threaded fasteners selectively raises said tensioning ring to tighten said drum head.

* * * * *